US011165187B2

(12) United States Patent
Sakai

(10) Patent No.: US 11,165,187 B2
(45) Date of Patent: Nov. 2, 2021

(54) CONNECTOR

(71) Applicant: Sumitomo Wiring Systems, Ltd., Yokkaichi (JP)

(72) Inventor: Masami Sakai, Yokkaichi (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/800,254

(22) Filed: Feb. 25, 2020

(65) Prior Publication Data

US 2020/0303863 A1 Sep. 24, 2020

(30) Foreign Application Priority Data

Mar. 20, 2019 (JP) ..... JP2019-052373

(51) Int. Cl.
*H01R 13/506* (2006.01)
*H01R 13/6477* (2011.01)

(52) U.S. Cl.
CPC ..... *H01R 13/506* (2013.01); *H01R 13/6477* (2013.01)

(58) Field of Classification Search
CPC ..... H01R 13/506; H01R 13/514; H01R 13/2421; H01R 13/516; H01R 13/582; H01R 13/6205; H01R 2107/00; H01R 2201/26; H01R 43/042; H01R 12/65; H01R 12/7052; H01R 12/71; H01R 12/721; H01R 12/73; H01R 12/737; H01R 13/00; H01R 13/115; H01R 13/187; H01R 13/2407; H01R 13/2492; H01R 13/26; H01R 13/42; H01R 13/4223; H01R 13/4226; H01R 13/4361; H01R 13/4367; H01R 13/4368; H01R 13/502; H01R 13/518; H01R 13/5202; H01R 13/56; H01R 13/621; H01R 13/6272; H01R 13/629; H01R 13/631;
(Continued)

(56) References Cited

U.S. PATENT DOCUMENTS 6,196,884 B1 * 3/2001 Tanaka ..... H01R 13/187 439/847
9,318,827 B2 * 4/2016 Osada ..... H01R 13/15
(Continued)

FOREIGN PATENT DOCUMENTS

JP 2017-204335 11/2017
JP 2018-147816 9/2018

*Primary Examiner* — Truc T Nguyen
(74) *Attorney, Agent, or Firm* — Gerald E. Hespos; Michael J. Porco; Matthew T. Hespos

(57) ABSTRACT

A connector (10) is to be connected to an end part of a cable (90). The cable (90) is formed by covering outer peripheries of at least two twisted wires (91) by an outer coating (92). The connector includes a conductive tubular portion (32) and an outer housing (60). The wires (91) are inserted into the tubular portion (32). The tubular portion (32) includes a suppressing portion (35) having an outer surface recessed from an outer surface of the tubular portion (32) and an inner surface projecting further toward the wires (91) than an inner surface of the tubular portion (32). The outer housing (60) includes an accommodating portion (62) for accommodating the tubular portion (32). The accommodating portion (62) includes a locking portion (66) to be fit into a recessed part of the suppressing portion (35) in an intersecting direction intersecting a withdrawing direction of the tubular portion (32).

3 Claims, 8 Drawing Sheets

(58) Field of Classification Search
CPC .. H01R 13/6315; H01R 13/639; H01R 13/64; H01R 13/642; H01R 13/646; H01R 13/6463; H01R 13/6581; H01R 13/6587; H01R 13/6594; H01R 13/6658; H01R 13/6683; H01R 13/74; H01R 2201/06; H01R 24/30; H01R 25/003; H01R 43/048; H01R 43/058; H01R 4/203
See application file for complete search history.

(56) References Cited

U.S. PATENT DOCUMENTS

| | | | | |
|---|---|---|---|---|
| 10,283,891 | B2 | 5/2019 | Maesoba et al. | |
| 2006/0292928 | A1* | 12/2006 | Morello | H01R 13/4226 439/595 |
| 2007/0149068 | A1* | 6/2007 | Shimizu | H01R 13/11 439/852 |
| 2007/0212950 | A1* | 9/2007 | Morello | H01R 13/426 439/752 |
| 2010/0041280 | A1* | 2/2010 | Morello | H01R 13/405 439/752 |
| 2013/0337704 | A1* | 12/2013 | Nagasaka | H01R 13/4223 439/877 |
| 2018/0294589 | A1* | 10/2018 | Humphrey | H01R 13/11 |
| 2020/0303865 | A1* | 9/2020 | Miyamura | H01R 13/514 |

* cited by examiner

CONNECTOR

BACKGROUND

Field of the Invention

The disclosure relates to a connector.

Related Art

Japanese Unexamined Patent Publication No. 2017-204335 discloses a connector for high-speed communication to be connected to an end part of a twisted pair cable. The twisted pair cable is formed by surrounding the outer peripheries of two twisted signal wires by an outer member. The connector includes a tubular shell and an outer housing for accommodating the shell. End regions of the two signal wires are exposed from the outer member, untwisted and inserted into the tubular shell.

Impedance tends to increase in the parts of the signal wires of the twisted pair cable that are exposed from the outer member and untwisted. Thus, the shell is formed such that a rear part thereof is smaller than a front part for the purpose of suppressing an impedance increase. Further, an impedance adjusting portion is formed inside the rear part of the shell in proximity to the signal wires.

Japanese Unexamined Patent Publication No. 2018-147816 discloses a connector of the type described above where a locked portion projects out on an outer conductor equivalent to the shell. The locked portion is locked by a terminal locking portion provided in a housing in a front-rear direction to retain the outer conductor in the housing. Such a technique is known from Japanese Unexamined Patent Publication No. 2018-147816.

The above-described shell with the rear part reduced in dimensions is more difficult to process than a shell that has the same dimensions in the front-rear direction. Further, rattling easily occurs when the shell is accommodated into the housing.

Further, miniaturization of connectors has been required in recent years. Thus, if the locked portion projects out as described above, it becomes difficult to miniaturize the outer conductor and the connector.

An object of this specification is to achieve miniaturization while suppressing an impedance increase.

SUMMARY

The disclosure is directed to a connector to be connected to an end part of a cable. The cable is formed by covering outer peripheries of at least two twisted wires by an outer coating. The connector includes a conductive tubular portion and an outer housing. End parts of the wires are exposed from the outer coating, untwisted and inserted into the tubular portion. The tubular portion includes a suppressing portion having an outer surface recessed from an outer surface of the tubular portion and an inner surface projecting farther toward the wires than an inner surface of the tubular portion. The outer housing includes an accommodating portion for accommodating the tubular portion. The accommodating portion includes a locking portion fit in a recess of the suppressing portion in a direction intersecting a withdrawing direction of the tubular portion when the tubular portion is accommodated in the accommodating portion.

Generally, an impedance tends to increase in parts of wires for transmitting a communication signal exposed from an outer coating and untwisted. However, according to such a connector, the wires exposed from the outer coating and untwisted and a suppressing portion are close to each other. That is, an impedance increase in the parts exposed from the outer coating and untwisted can be suppressed by arranging the suppressing portion in proximity to the wires.

Further, the suppressing portion and the locking portion are fit together. Thus, the locking portion and the tubular portion are locked to each other in the withdrawing direction of the tubular portion to retain the tubular portion. In this way, the tubular portion and the connector can be reduced in size as compared to the case where a locked portion lockable by the locking portion is formed to project out from the tubular portion.

Furthermore, the suppressing portion for suppressing an impedance increase doubles as a locked portion to be locked by the locking portion. Thus, the tubular portion and eventually the connector can be reduced in size as compared to the case where the suppressing portion and the locked portion are separate. Here, locking means that the suppressing portion and the locking portion are locked to each other to stop each other and indicates that the tubular portion contacts the locking portion in the withdrawing direction of the tubular portion to stop the tubular portion.

The connector may further include an inner housing, and end parts of the untwisted wires may be accommodated in the inner housing. The inner housing is accommodatable in the tubular portion, and the suppressing portion is arranged between the inner housing and the outer coating. In this embodiment, the suppressing portion is between the inner housing and the outer coating. Thus, dimensions of the tubular portion can be reduced as compared to the case where the suppressing portion is arranged outside the inner housing. In this way, the tubular portion and the connector can be reduced in size.

The wires may be drawn out rearward from the inner housing, and the suppressing portion may be lockable to an end part of the inner housing on a side toward which the wires are drawn out in a draw-out direction of the wires with the inner housing accommodated in the tubular portion.

The suppressing portion capable of suppressing an impedance increase and lockable by the locking portion can double as a retaining portion for retaining the inner housing. In this way, a retaining structure for retaining the inner housing in the tubular portion can be reduced in size as compared to the case where the suppressing portion and the retaining portion are provided separately. In this way, the connector can be reduced further in size.

A part of the locking portion fit in the recessed part may have a length in the withdrawing direction of the tubular portion larger than a length in the intersecting direction.

Generally, it is considered to make a locking area of a suppressing portion and a locking portion larger to make a locking force of the locking portion to lock the suppressing portion larger. However, in the case of reducing a height of a connector, a large locking margin of the suppressing portion and the locking portion cannot be secured in a vertical direction. However, since the part of the locking portion fit in the recessed part has the length in the withdrawing direction of the tubular portion larger than the length in the intersecting direction, a shear area of the locking portion by the suppressing portion can be increased.

According to the present disclosure, it is possible to realize miniaturization while suppressing an impedance increase.

DETAILED DESCRIPTION

A specific example of the connector of the present disclosure is described below with reference to the drawings. Note that the present disclosure is not limited to these illustrations and is intended to be represented by claims and include all changes in the scope of claims and in the meaning and scope of equivalents.

An embodiment of the disclosure is described with reference to FIGS. 1 to 9. This embodiment relates to a connector 10 for high-speed communication to be installed in a vehicle and illustrates the connector 10 to be connected to a front part of a cable 90 as shown in FIG. 1.

[Cable 90]

Figure 1:
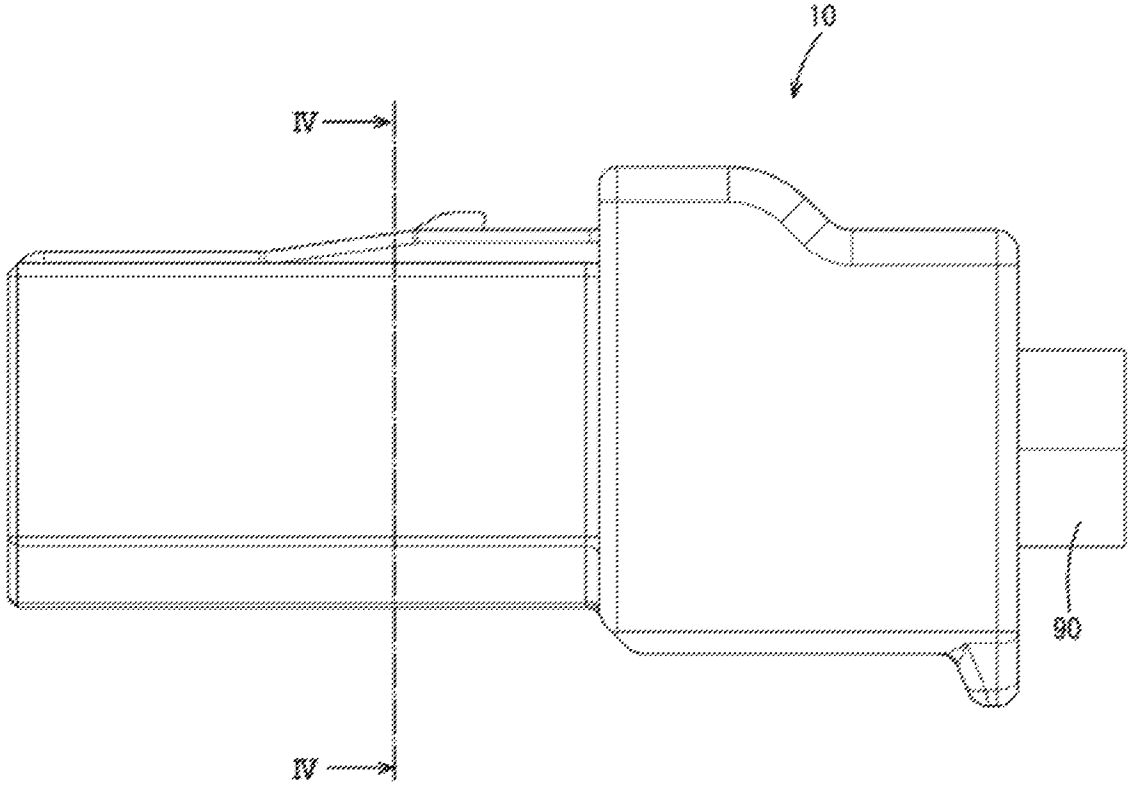
FIG. 1 is a side view of a connector according to an embodiment.
Figure 3:
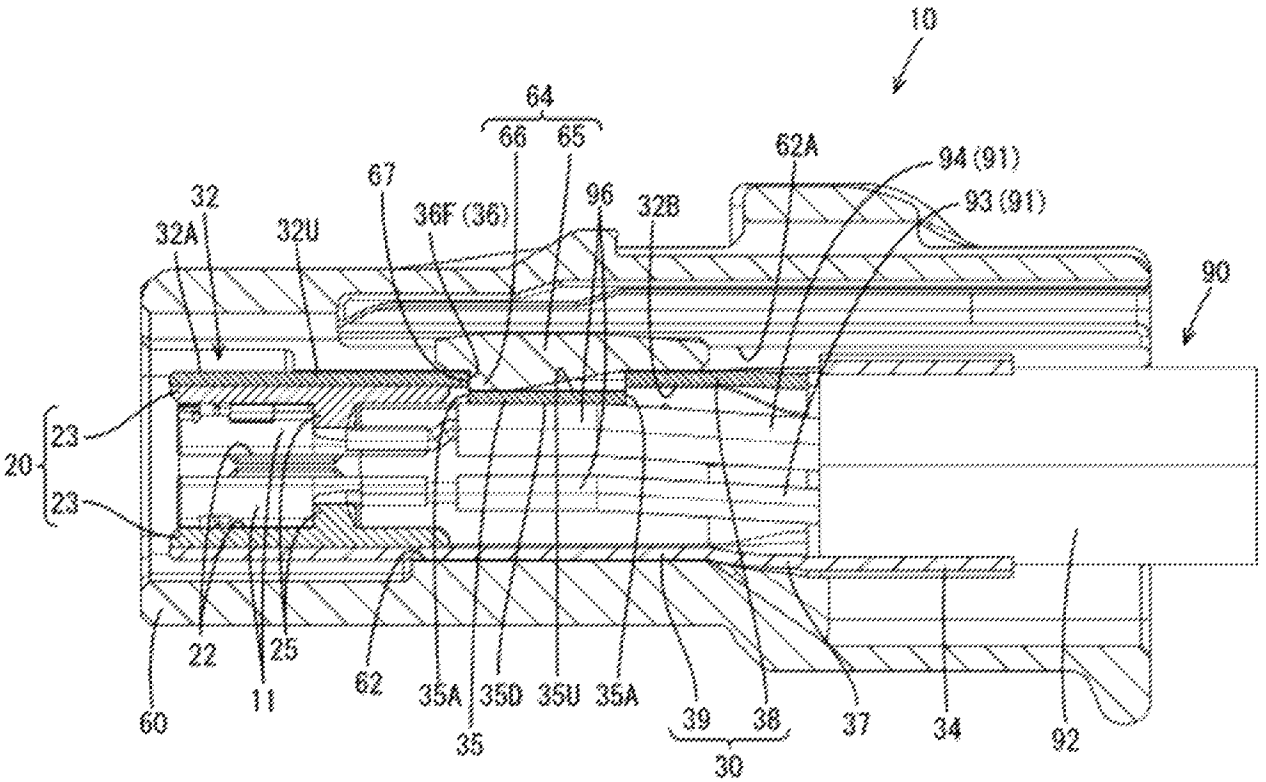
FIG. 3 is a section along of FIG. 2.

As shown in FIGS. 1 and 3, the cable 90 extends in a front-rear direction. The cable 90 is formed by covering the outer peripheries of a plurality of wires 91 by an insulating outer coating 92. The cable 90 of this embodiment is formed by collectively covering four wires 91 by the outer coating 92. Each wire 91 is formed by covering a conductive core by an insulating insulation coating.

Figure 4:
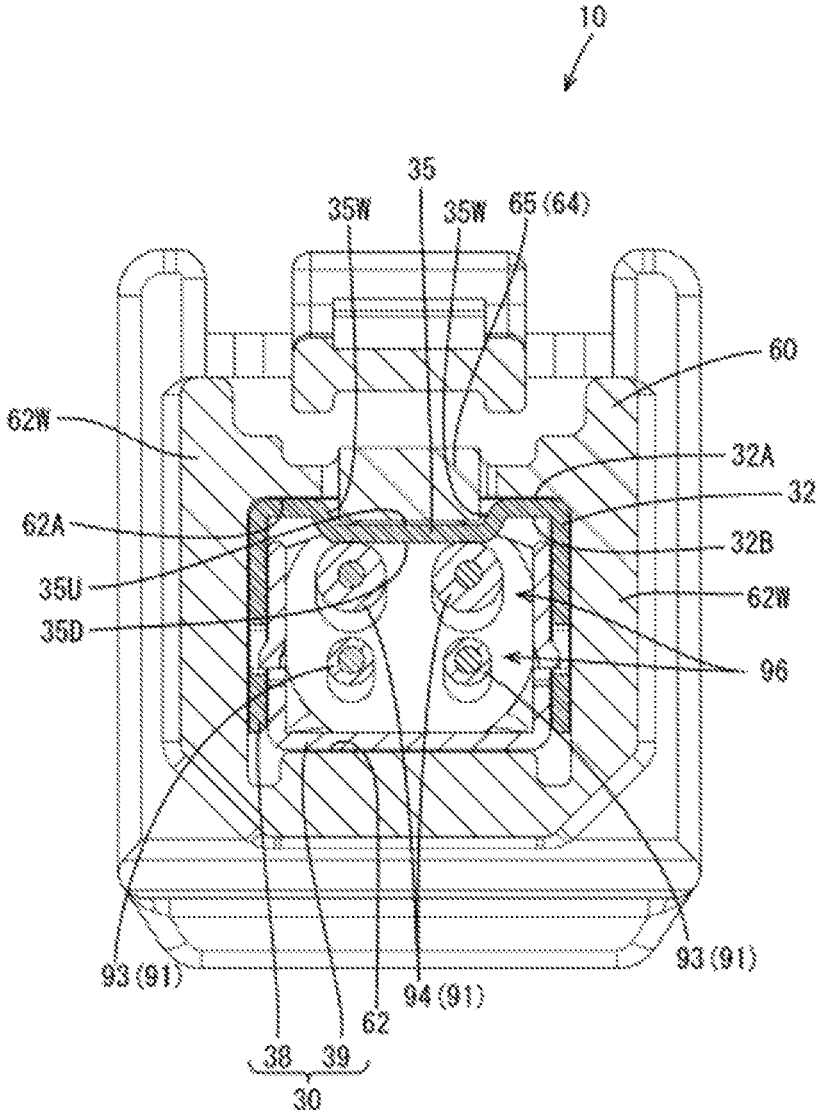
FIG. 4 is a section along IV-IV of FIG. 1.
Figure 5:
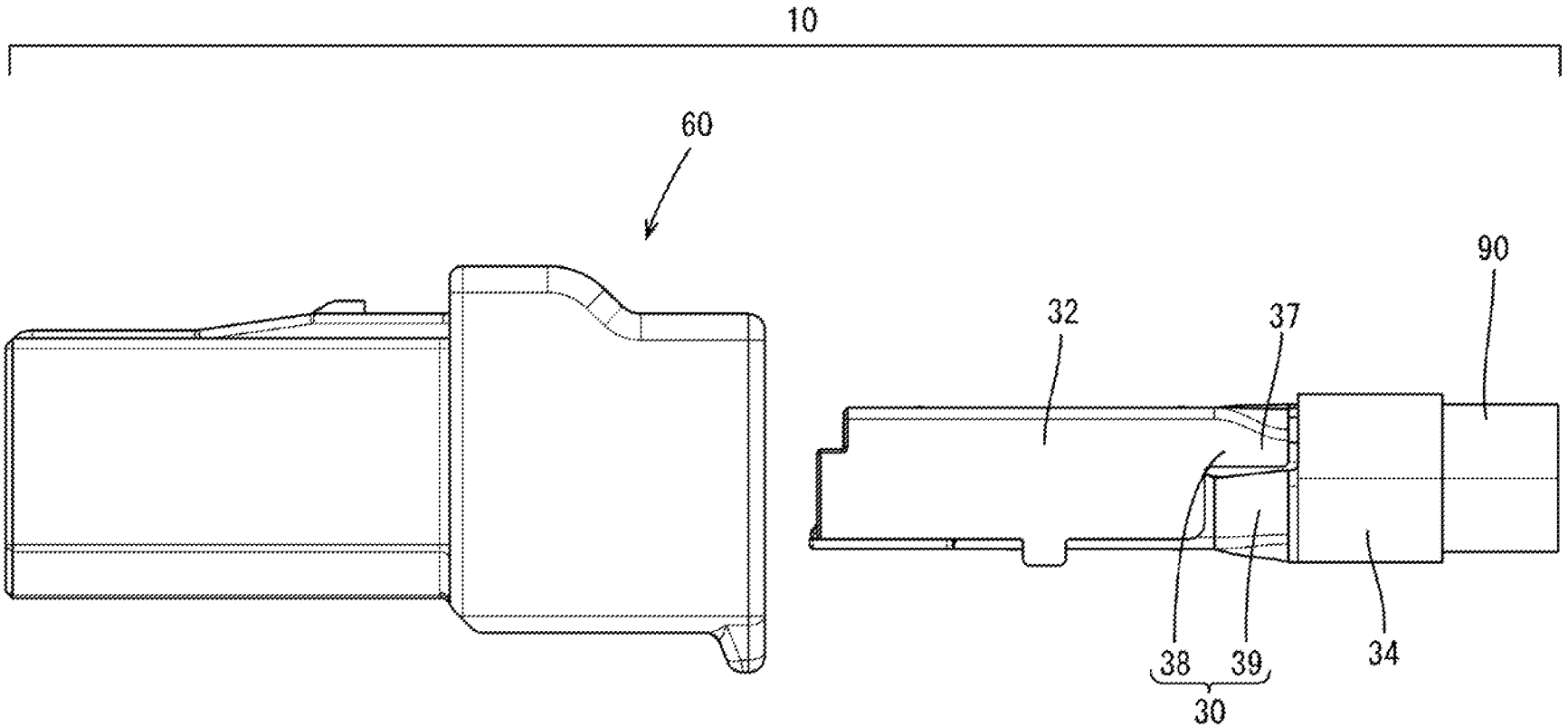
FIG. 5 is a side view showing a state before an outer conductor is accommodated into an outer housing.

As shown in FIG. 4, out of the four wires 91, two wires 91 serve as power supply wires 93 for power supply. Out of the four wires 91, the other two wires serve as signal wires 94 for transmitting a differential signal for communication. The two signal wires 94 are twisted to each other in a state covered by the outer coating 92.

As shown in FIG. 3, the outer coating 92 is stripped to expose the four wires 91 at an end of the cable 90. The two exposed signal wires 94 are untwisted and separated from each other.

[Connector 10]

As shown in FIGS. 1 to 4, the connector 10 includes four inner conductors 11, an inner housing 20 for accommodating the four inner conductors 11, an outer conductor 30 for accommodating the inner housing 20 and an outer housing 60 for accommodating the outer conductor 30.

[Inner Conductors 11]

The inner conductors 11 are formed as female terminals, such as by press-working a conductive metal plate material. The inner conductors 11 are connected respectively to ends of the wires 91 exposed from the outer coating 92 as shown in FIG. 3.

[Inner Housing 20]

Figure 2:
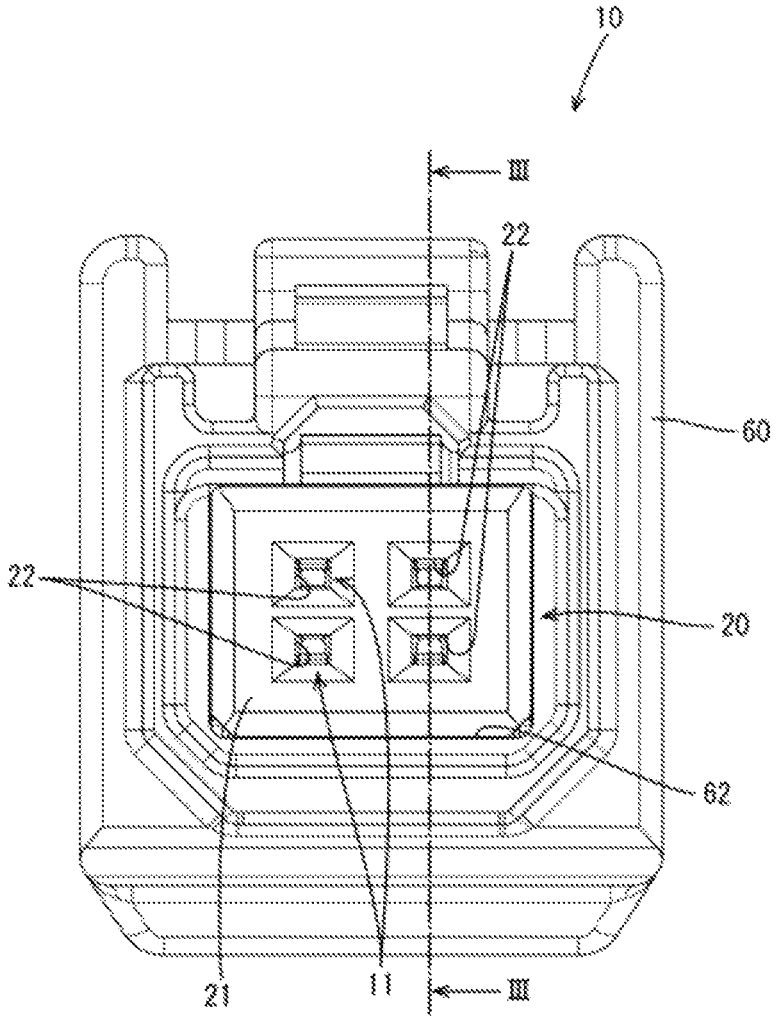
FIG. 2 is a front view of the connector.

As shown in FIG. 2, the inner housing 20 is a rectangular tube formed from insulating synthetic resin. A front retainer 21 is mounted on the front end of the inner housing 20. Note that the front retainer 21 is not shown in FIGS. 3, 5 and 6.

The inner housing 20 includes cavities 22 aligned in two rows and two columns in vertical and lateral directions.

The inner conductor 11 and an end part of the wire 91 connected to the inner conductor 11 are accommodated in each cavity 2, as shown in FIG. 3. Two cavities 22 in an upper row accommodate the inner conductors 11 connected to the signal wires 94. Two cavities 22 in a lower row accommodate the inner conductors 11 connected to the power supply wires 93.

The inner housing 20 is configured by assembling two divided bodies 23 in the vertical direction. When the inner housing 20 is configured, each inner conductor 11 is retained in the cavity 22 by being locked in the front-rear direction by an inner conductor locking portion 25 formed in the cavity 22 as shown in FIG. 3.

The four wires 91 drawn out rearward from a rear part of the inner housing 20 are exposed parts 96 exposed from the inner housing 20 and the outer coating 92. The exposed portions 96 of the two signal wires 94 are untwisted.

[Outer Conductor 30]

The outer conductor 30 is formed, such as by press-working a conductive metal plate material. As shown in FIGS. 3 to 6, the outer conductor 30 includes a tubular portion 32 for accommodating the inner housing 20, a crimping portion 34 to be crimped to the outer coating 92 and a linking portion 37 linking the tubular portion 32 and the crimping portion 34. Further, the outer conductor 30 is formed by assembling an upper conductor 38 and a lower conductor 39 in the vertical direction.

Figure 6:
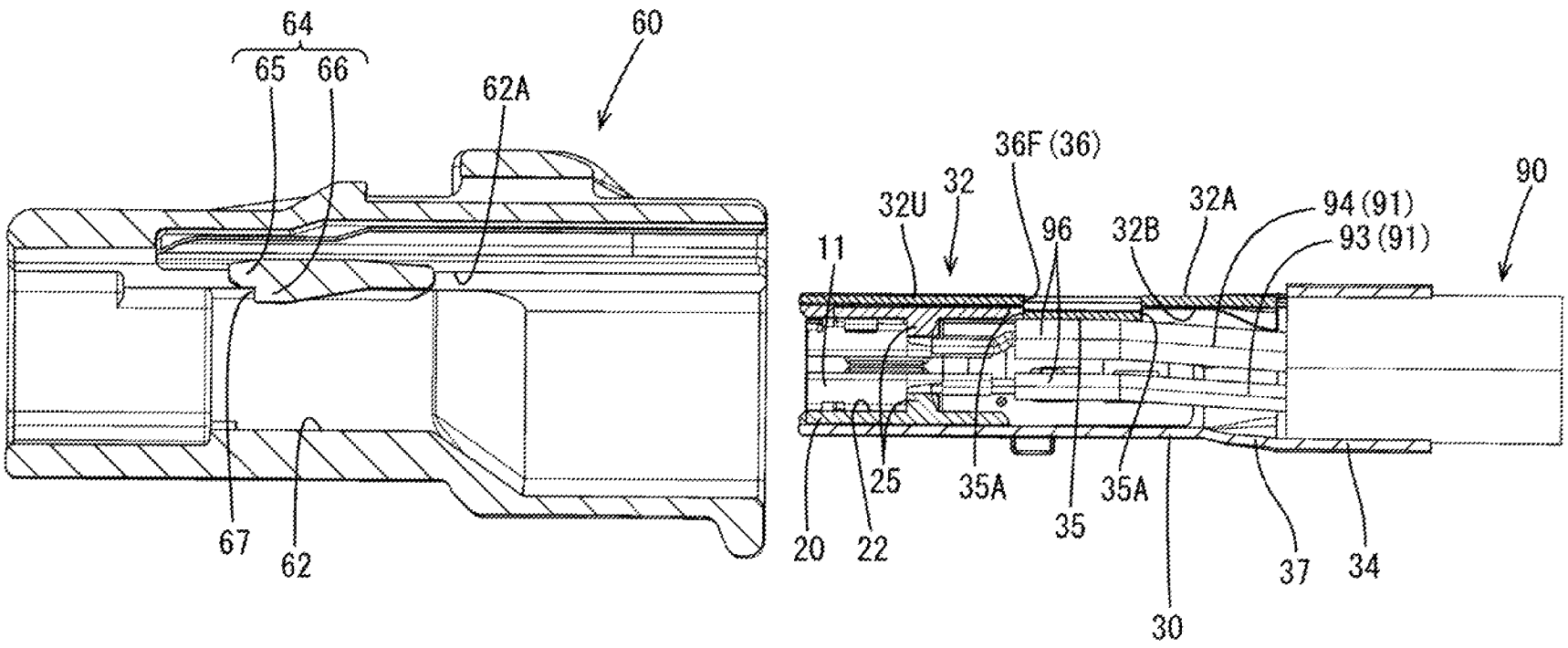
FIG. 6 is a section, corresponding to a cross-section of FIG. 3, showing the state before the outer conductor is accommodated into the outer housing.

The tubular portion 32 is formed into a rectangular tube having the same dimensions in the front-rear direction by vertically assembling the upper conductor 38 and the lower conductor 39. As shown in FIGS. 3 and 6, the inner housing 20 is accommodated into a front part of the tubular portion 32. The exposed portions 96 of the four wires 91 extending rearward from the inner housing 20 are accommodated in a rear part of the tubular portion 32 while being passed through this rear part in the front-rear direction. The exposed portions 96 of the four wires 91 in the tubular portion 32 extend rearward while being pulled out from the respective cavities 22. The exposed portions 96 of the two signal wires 94 are arranged above the exposed portions 96 of the two power supply wires 93 in the tubular portion 32.

Figure 7:
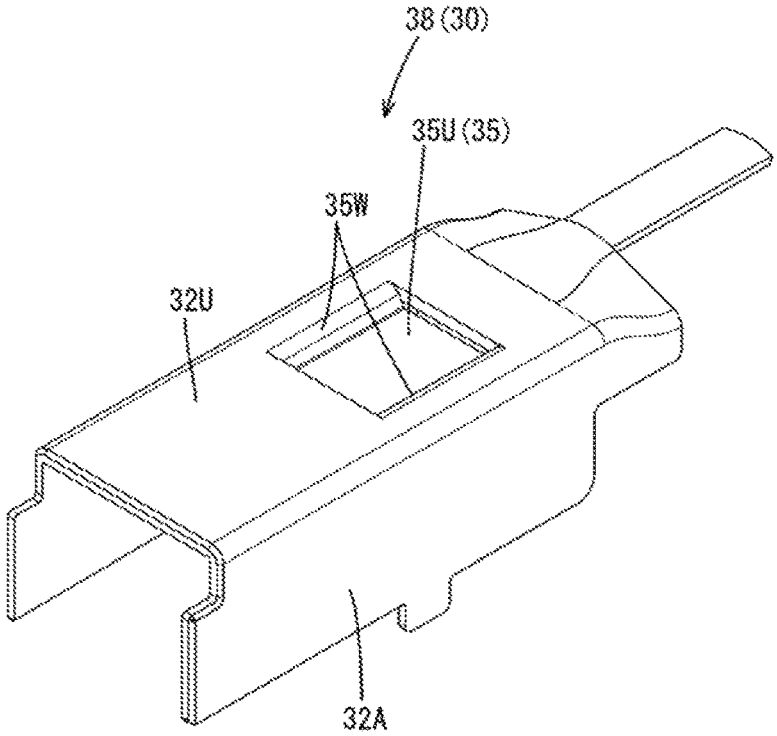
FIG. 7 is a perspective view of an upper conductor.
Figure 8:
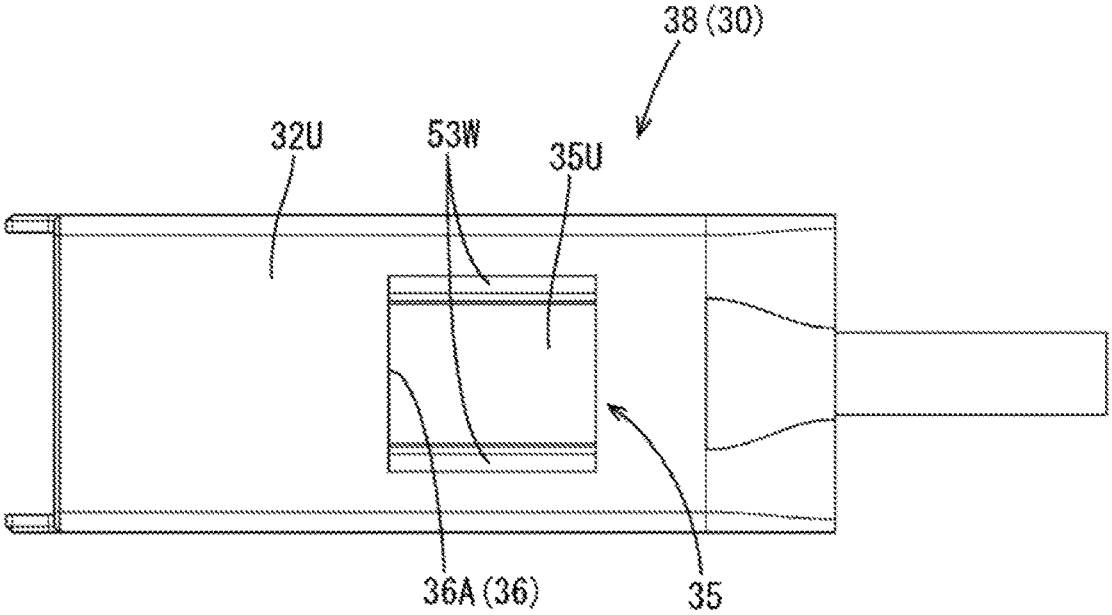
FIG. 8 is a plan view of the upper conductor.
Figure 9:
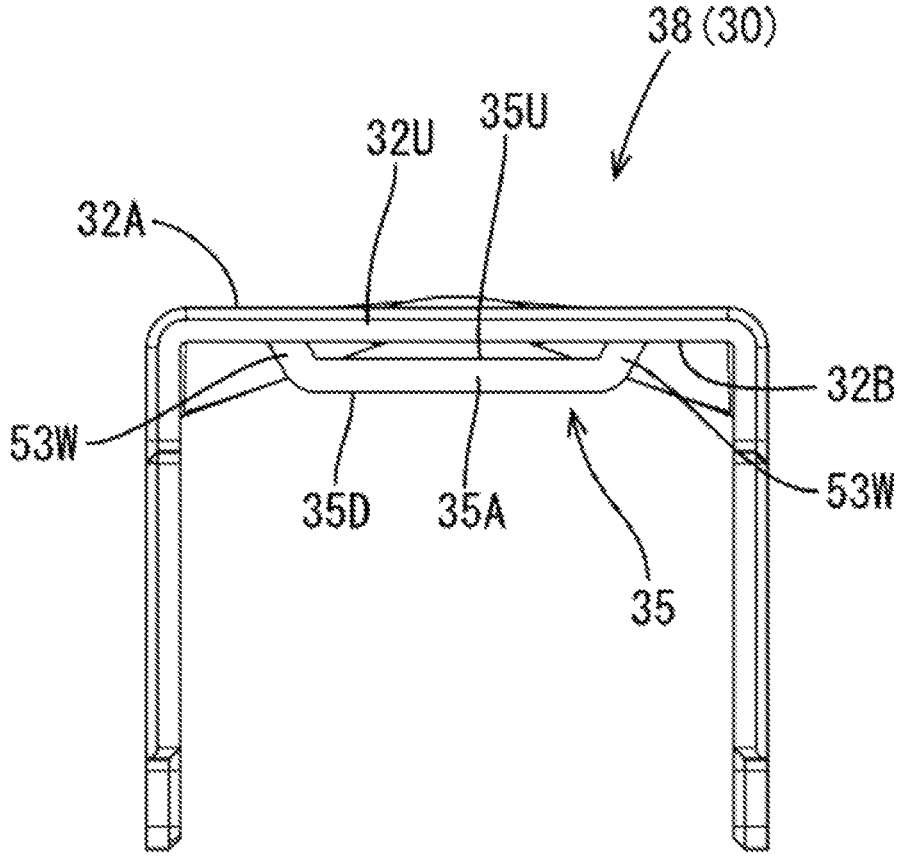
FIG. 9 is a front view of the upper conductor.

As shown in FIG. 3, a suppressing portion 35 having a rectangular shape in a plan view is formed on an upper surface 32A of the rear part of the tubular portion 32. As shown in FIGS. 7 to 9, the suppressing portion 35 is formed such that an upper surface 35U is recessed from the upper plate 32A of the tubular portion 32 and a lower surface 35D projects farther down than an upper inner surface 32B of the tubular portion 32. The front and rear edges of the suppressing portion 35 are divided from an upper plate 32U of the tubular portion 32 in the front-rear direction and both lateral side edges 35W are connected to the upper plate 32U of the tubular portion 32. Thus, a part of the suppressing portion 35 projecting inwardly of the tubular portion 32 is in the form of a flat plate supported on both ends.

Boundary parts of the upper surface 32U of the tubular portion 32 with the suppressing portion 35 serve as cut surfaces 36 upright in the vertical direction. The front and rear end surfaces of the suppressing portion 35 divided from the upper plate 32U of the tubular portion 32 serve as cut surfaces 35A projecting farther inward of the tubular portion 32 than the upper plate 32U of the tubular portion 32 and upright in the vertical direction.

As shown in FIG. 4, a length of the suppressing portion 35 in the lateral direction is larger than a length in the lateral direction between outer sides of the exposed portions 96 of the two signal wires 94 inserted in the tubular portion 32.

As shown in FIG. 3, the suppressing portion 35 is located between the inner housing 20 and the outer coating 92 with the inner housing 20 accommodated in the tubular portion 32.

That is, when the inner housing 20 is accommodated into the tubular portion 32, the suppressing portion 35 is arranged in proximity to the exposed portions 96 of the two signal wires 94 to cover upper parts of the exposed portions 96. Further, the cut surface 35A formed on the front surface of the suppressing portion 35 is locked to a rear part of the inner housing 20 in the front-rear direction, whereby the inner housing 20 is prevented from coming out rearward.

The crimping portion 34 is formed in a rear end part of the lower conductor 39. The crimping portion 34 is crimped to surround the outer periphery of the outer coating 92.

The linking portion 37 is formed such that both lateral side edge parts are constricted toward a vertical center from the upper and lower edges of the tubular portion 32. A lower end part of the linking portion 37 (linking portion 37 in the lower conductor 39) is connected to the lower end edge of the crimping portion 34. Thus, the linking portion 37 covers the outer peripheries of the four wires 91 extending in the front-rear direction between the outer coating 92 having the crimping portion 34 crimped thereto and the tubular portion 32.

[Outer Housing 60]

The outer housing 60 is made of insulating synthetic resin. As shown in FIGS. 3 and 6, the outer housing 60 includes an accommodating portion 62 capable of accommodating the outer conductor 30. The accommodating portion 62 extends in the front-rear direction and has a rectangular opening. The opening of the accommodating portion 62 has substantially the same outer shape as the outer conductor 30, and the outer coating 30 is fit and accommodated into the accommodating portion 62.

An upper wall 62A is formed with a locking piece 64 in a central part of the accommodating portion 62 in the front-rear direction. The locking piece 64 includes a locking piece body 65 cantilevered forward with a rear end as a starting point and a locking portion 66 formed to project downward on a lower end part of the locking piece body 65.

As shown in FIG. 4, a rear end part of the locking piece body 65 is connected to side walls 62W on both lateral sides of the accommodating portion 62. The locking piece body 65 is resiliently displaceable in the vertical direction with a rear end part connected to the side walls 62B as a fulcrum.

As shown in FIGS. 3 and 6, the locking portion 66 has a locking surface 67 obliquely facing toward a front-lower side on a front end part, and a length of the locking portion 66 in the front-rear direction is larger than a downward projecting dimension of the locking portion 66. When the outer conductor 30 is accommodated into the accommodating portion 62, the locking portion 66 is fit into a recessed part of the suppressing portion 35 of the outer conductor 30 from above.

With the locking portion 66 fit to the suppressing portion 35, a part of the locking portion 66 fit in the recessed part of the suppressing portion 35 has a length in the front-rear direction larger than a length in the vertical direction as shown in FIGS. 3 and 6. With the locking portion 66 and the suppressing portion 35 fit, the front cut surface 36F of the tubular portion 32 formed in the boundary part of the upper plate 32U of the tubular portion 32 and the suppressing portion 35 and the locking surface 67 of the locking portion 66 can be locked to each other in the front-rear direction. In this way, the outer conductor 30 accommodated in the accommodating portion 62 is prevented from coming out rearward.

This embodiment is configured as described above. Next, functions and effects of the connector 10 are described.

In recent years, connectors to be connected to end parts of cables to be routed in vehicles have been required to be reduced in height and size. Further, for example, in the case of a cable in which two twisted signal wires are covered by an outer coating, an impedance tends to increase in a part where the outer coating is stripped and the two untwisted signal wires are routed.

To suppress an impedance increase of the signal wires, it is considered to reduce dimensions of an outer conductor for covering the untwisted signal wires in a connector or form an adjusting portion disposed in proximity to the signal wires inside the outer conductor.

However, in the case of forming the adjusting portion inside the outer conductor, the processing of the outer conductor becomes complicated. Further, if the outer conductor is formed with a part having small dimensions, the outer conductor easily rattles in a housing for accommodating the outer conductor.

Accordingly, the present inventor and other researchers found out the configuration of this embodiment as a result of earnest study to solve the above problem.

Specifically, this embodiment relates to the connector 10 to be connected to the end part of the cable 90, wherein the cable 90 is formed by covering the outer peripheries of at least two twisted signal wires (wires) 94 by the outer coating 92 and the connector 10 includes the conductive tubular portion 32 and the outer housing 60. The at least two signal wires 94 exposed from the outer coating 92 and untwisted are inserted into the tubular portion 32. The tubular portion 32 includes the suppressing portion 35 having the upper surface (outer surface) 35U recessed from the upper surface (outer surface) 32A of the tubular portion 32 and the lower surface (inner surface) 35D projecting further toward the signal wires 94 than the upper inner surface 32B of the tubular portion 32. The outer housing 60 includes the accommodating portion 62 for accommodating the tubular portion 32, and the accommodating portion 62 includes the locking portion 66 fit in the recessed part of the suppressing portion 35 in the vertical direction (intersecting direction intersecting a withdrawing direction of the tubular portion 32) with the tubular portion 32 accommodated in the accommodating portion 62.

An impedance tends to increase in the parts (exposed portions 96) of the signal wires 94 exposed from the outer coating 92 and untwisted. However, according to this embodiment, the exposed portions 96 and the suppressing portion 35 are close to each other as shown in FIGS. 3 and 4. That is, an impedance increase in the exposed portions 96 can be suppressed by arranging the suppressing portion 35 in proximity to the exposed portions 96.

Further, the tubular portion 32 suppresses an impedance increase by forming the suppressing portion 35 having the recessed upper surface 35U. That is, for example, the tubular portion needs not be formed to have small dimensions or formed with the adjusting portion inside. In this way, it can be suppressed that the tubular portion 32 rattles in the accommodating portion 62 and the structure of the tubular portion 32 becomes complicated.

Further, as shown in FIGS. 3 and 6, the recessed part of the suppressing portion 35 and the locking portion 66 are vertically fit, whereby the locking portion 66 is locked to the tubular portion 32 in the withdrawing direction to prevent the tubular portion 32 from coming out rearward. In this way, the tubular portion 32 and eventually the connector 10 can be reduced in size as compared to the case where a locked portion lockable by a locking portion is formed to project upward from the upper surface of a tubular portion. Further, the suppressing portion 35 for suppressing an impedance increase doubles as a locked portion to be locked by the locking portion 66. In this way, the tubular portion 32 and eventually the connector 10 can be reduced in size as compared to the case where the suppressing portion and the locked portion are separately provided.

The inner housing 20 further is provided, the end parts of the untwisted signal wires (wires) 94 are accommodated in the inner housing 20, the inner housing 20 can be accommodated into the tubular portion 32, and the suppressing portion 35 is disposed to project between the inner housing 20 and the outer coating 92.

Since the suppressing portion 35 is arranged between the inner housing 20 and the outer coating 92, the dimensions of the tubular portion 32 can be reduced, for example, as compared to the case where a suppressing portion is arranged outside an inner housing. In this way, the tubular portion 32 and eventually the connector 10 can be reduced in size.

The wires 91 are drawn out rearward from the inner housing 20 and the suppressing portion 35 is lockable to the rear end part (end part on a side to which the wires 91 are drawn out) of the inner housing 20 in the front-rear direction (draw-out direction of the wires 91) as shown in FIGS. 3 and 6 with the inner housing 20 accommodated in the tubular portion 32.

The suppressing portion 35 capable of suppressing an impedance increase and lockable by the locking portion 66 can double as a retaining portion for retaining the inner housing 20. In this way, a retaining structure of the inner housing 20 in the tubular portion 32 can be reduced in size as compared to the case where a suppressing portion and a retaining portion are separately provided. In this way, the connector 10 can be reduced further in size.

As shown in FIG. 3, the part of the locking portion 66 fit in the recessed part of the suppressing portion 35 has the length in the front-rear direction (withdrawing direction of the tubular portion 32) larger than the length in the vertical direction (intersecting direction).

Generally, it is considered to make a locking area of a suppressing portion and a locking portion larger to make a locking force of the locking portion to lock the suppressing portion larger. However, in the case of reducing a height of a connector, a large locking margin of the suppressing portion and the locking portion cannot be secured in the vertical direction. However, the part of the locking portion 66 fit in the recessed part of the suppressing portion 35 has the length in the front-rear direction larger than the length in the vertical direction. In this way, a shear area of the locking portion 66 by the suppressing portion 35 can be increased. Specifically, a locking force of the locking portion 66 to lock the outer conductor 30 can be increased while the connector 10 is reduced in height.

Other Embodiments

The invention is not limited to the above described and illustrated embodiment. For example, the following various modes also are included.

The cable 90 includes two signal wires 94 and two power supply wires 93. However, a cable may include only two signal wires or may include ground wires, a braided wire and the like.

The tubular portion 32 of the outer conductor 30 is constituted by combining the upper conductor 38 and the lower conductor 39. However, either one of an upper conductor or a lower conductor may constitute a tubular portion.

In the above embodiment, the front and rear edges of the suppressing portion 35 are divided from the upper plate 32U of the tubular portion 32. However, without limitation to this, an upper plate of a tubular portion and front and rear edges of a suppressing portion may be connected if the suppressing portion and a locking portion are fit and the tubular portion and the locking portion are lockable to each other in the front-rear direction.

In the above embodiment, the part of the suppressing portion 35 projecting into the tubular portion 32 is a flat plate. However, without limitation, a part of a suppressing portion projecting into a tubular portion may have a rounded shape or may be bent in conformity with the shape of wires.

The inner conductor 11 shaped as a female terminal is connected to the end of each wire 91. However, without limitation to this, an inner conductor may have a male shape.

LIST OF REFERENCE SIGNS

10: connector
11: inner conductor
20: inner housing
21: front retainer
22: cavity
23: divided body
25: inner conductor locking portion
30: outer conductor
32: tubular portion
32A: upper surface of tubular portion
32B: upper inner surface of tubular portion
32U: upper plate of tubular portion
34: crimping portion
35: suppressing portion
35A: cut surface of suppressing portion
35D: lower surface of suppressing portion
35U: upper surface of suppressing portion
35W: both side edges of suppressing portion
36: cut surface of tubular portion
36F: front cut surface of tubular portion
37: linking portion
38: upper conductor
39: lower conductor
60: outer housing
62: accommodating portion
62A: upper wall of accommodating portion
62W: side wall of accommodating portion
64: locking piece
65: locking piece body
66: locking portion
67: locking surface
90: cable
91: wire
92: outer coating
93: power supply wire
94: signal wire
96: exposed portion

What is claimed is:

1. A connector to be connected to an end part of a twisted pair cable, the twisted pair cable is formed by covering outer peripheries of at least two wires by an outer coating, end parts of the at least two wires being exposed from the outer coating in an untwisted state, the connector comprising:

an outer housing, a conductive tubular portion disposed in the outer housing and an inner housing disposed in the tubular portion;

the at least two wires exposed from the outer coating being inserted into the tubular portion and end parts of the untwisted wires being accommodated in the inner housing;

the inner housing is accommodatable in the tubular portion, and the tubular portion having opposite inner and outer surfaces and further including a suppressing portion arranged between the inner housing and the outer coating, the suppressing portion having an outer surface recessed from the outer surface of the tubular portion and an inner surface projecting farther toward the wires than the inner surface of the tubular portion, the outer housing includes an accommodating portion for accommodating the tubular portion, and the accommodating portion includes a locking portion fit in a recessed part of the suppressing portion in a direction intersecting a withdrawing direction of the tubular portion when the tubular portion is accommodated in the accommodating portion.

2. The connector of claim 1, wherein:

the wires are drawn out rearward from the inner housing, and the suppressing portion is lockable to an end part of the inner housing on a side, toward which the wires are drawn out, in a draw-out direction of the wires with the inner housing accommodated in the tubular portion.

3. The connector of claim 2, wherein a part of the locking portion fit in the recessed part is set to have a length in a withdrawing direction of the tubular portion that is larger than a dimension of the locking portion in a direction intersecting the withdrawing direction.

* * * * *